United States Patent [19]

Hobbs

[11] 4,239,188

[45] Dec. 16, 1980

[54] TREE HANDLING DEVICE

[76] Inventor: Edwin L. Hobbs, 10 Lance Ct., Moraga, Calif. 94556

[21] Appl. No.: 34,463

[22] Filed: Apr. 30, 1979

[51] Int. Cl.[3] ..... B66C 23/60

[52] U.S. Cl. ..... 254/376; 414/23; 254/380; 248/637; 242/77

[58] Field of Search ..... 254/139.1, 186 HC; 414/23; 242/117; 214/61

[56] References Cited

U.S. PATENT DOCUMENTS

| | | | |
|---|---|---|---|
| 1,133,592 | 3/1915 | Voigt et al. | 242/117 |
| 2,588,749 | 3/1952 | Nilsson | 254/139 |
| 2,708,525 | 5/1955 | Woleslagle | 212/61 |
| 2,725,991 | 12/1955 | Mäenpää | 414/23 |
| 3,367,632 | 2/1968 | Vail | 254/139 |

*Primary Examiner*—Leonard D. Christian
*Attorney, Agent, or Firm*—James R. Cypher

[57] ABSTRACT

A device for use by arborists for handling heavy tree limbs and main stems including a base for attachment to the tree trunk and a cylindrical member for receiving a rope mounted on the base. In an alternate form of the invention, the cylindrical member is mounted on an axle which is attached to the base and ratchets permit selective rotation of the cylindrical member in at least one direction. In still another form of the invention, a lever is attached to the cylinder to give an operator great mechanical advantage so that the device may be used to raise heavy loads by turning the cylindrical member.

11 Claims, 11 Drawing Figures

TREE HANDLING DEVICE

BACKGROUND OF THE INVENTION

The standard procedure for lowering a heavy limb or a cut portion of the main stem of a tree is set forth in Bulletin 5, *Topping Trees Before Removal, Tree Felling, International Shade Tree Conference, Inc., Western Chapter.* Briefly, the procedure consists of providing a lashing around the tree about 12 inches below the proposed cut in the tree. A rope used to lower the severed limb or main stem is then threaded through about three turns of the lashing and then secured to the limb or main stem to be severed about 12 inches above the proposed cut. The lower end of the rope is then wrapped several times around the trunk of the tree at ground level, and secured with a half hitch. The operator on the ground stands clear while the operator in the tree makes the cut. After the cut is made, the half hitch is removed by the ground operator and the heavy limb or main stem is lowered to the ground using the wraps of the rope around the tree trunk to provide friction so that one operator may lower the heavy load.

The standard procedure set forth above does not provide any way for the ground operator to raise the severed limb or main stem if it should become caught in a limb crotch or other obstruction while being lowered.

Another problem with the present method is the fact that the rough bark on some trees is extremely abrasive and harmful to the rope as the rope slides around the trunk while the limb is being lowered.

A further problem is the time consuming chore of wrapping yards and yards of a long rope around the tree trunk.

SUMMARY OF THE INVENTION

The gist of the present invention is the use of a device with a base which is removably attached to the tree trunk near ground level. A smooth cylinder is attached to the base and provides a smooth relatively small diameter surface positioned at right angles to the axis of the tree. The lowering rope is wrapped several turns around the cylinder and provides the necessary friction to control the lowering of very heavy loads by a single operator.

Another object is to provide a rugged device with few moving parts which will enable a tree arborist to quickly and safely handle very heavy loads.

A still further object is to provide a device which can be used to raise as well as lower very heavy loads.

A still further object is to provide a load handling device which can be more quickly attached and detached from the tree trunk than present methods of wrapping the lowering rope completely around the tree trunk.

Another object is to provide a device which will ensure a longer life for the lowering rope.

DESCRIPTION OF THE PREFERRED FORM OF THE INVENTION

Figure 1:
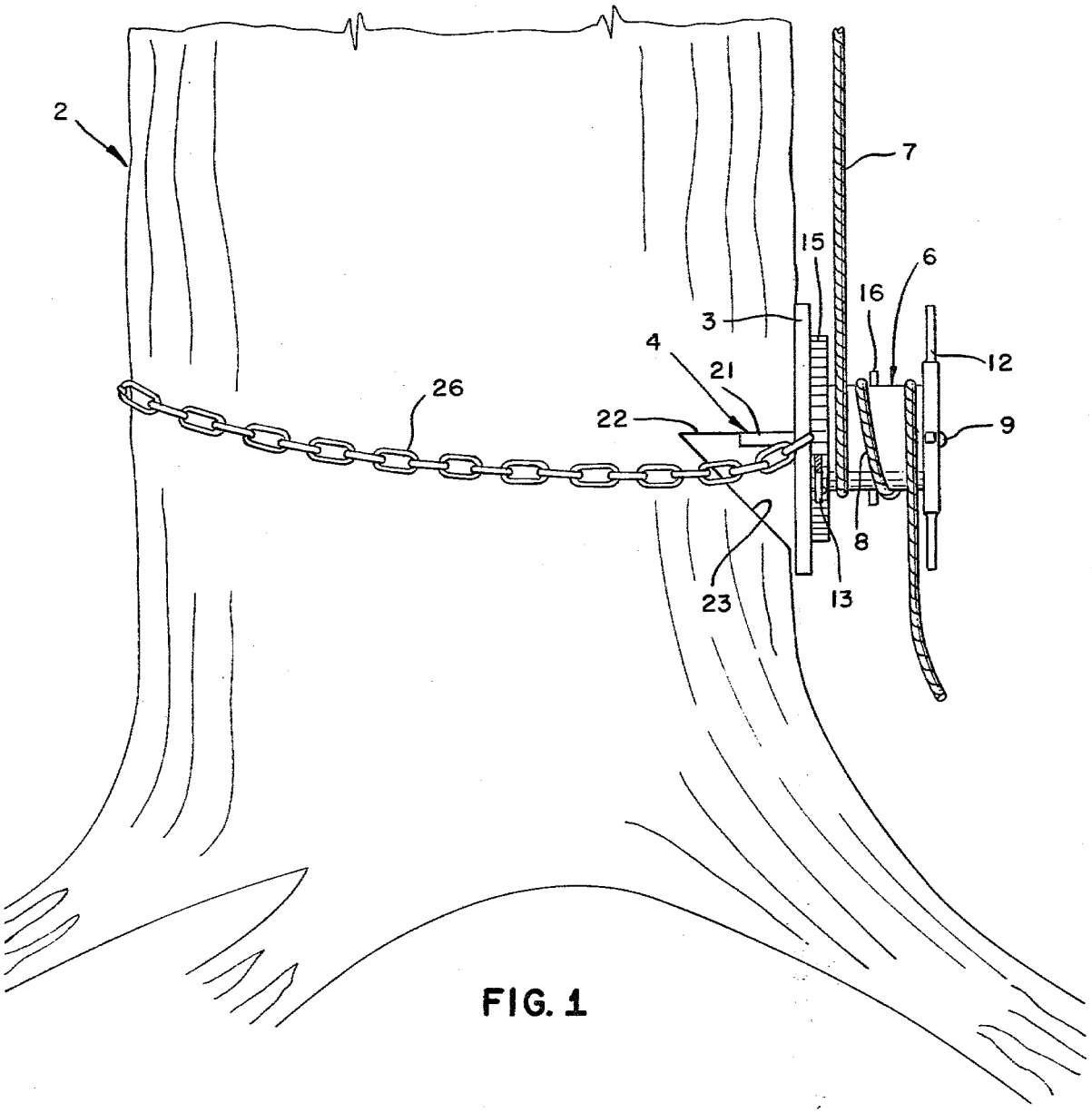
FIG. 1 is a side view of the device mounted on the trunk of a tree.
Figure 2:
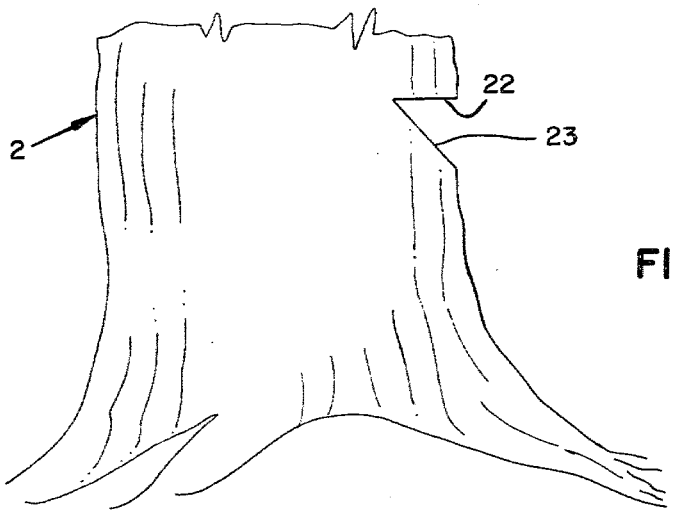
FIG. 2 is a view of the tree trunk of FIG. 1 which has been prepared for receiving the device shown in FIG. 1.
Figure 3:
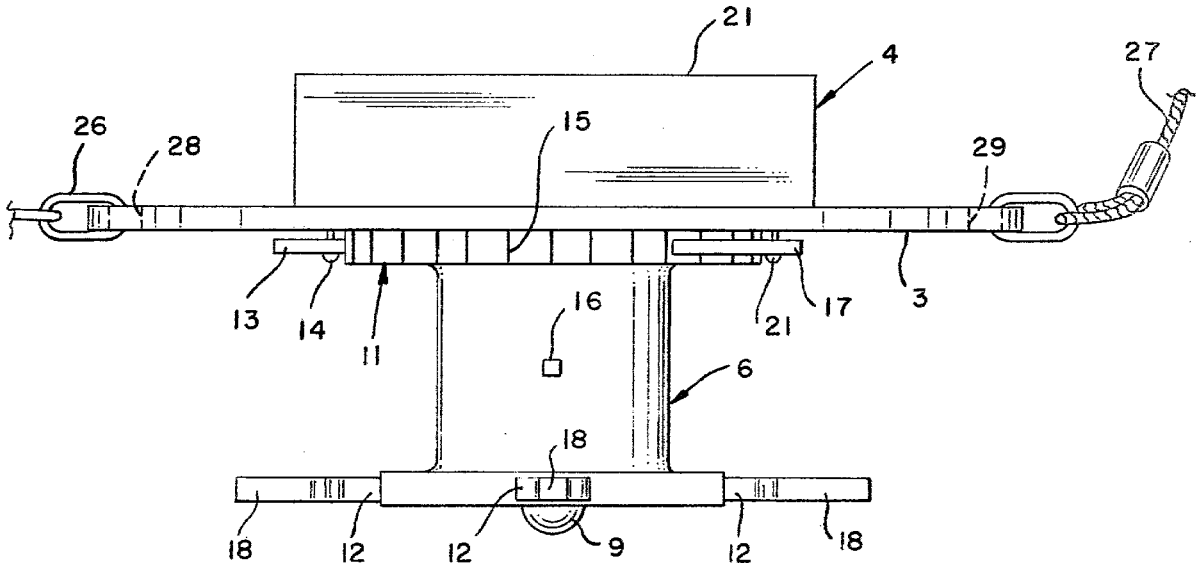
FIG. 3 is a top view of the device shown in FIG. 1 on a slightly larger scale.
Figure 4:
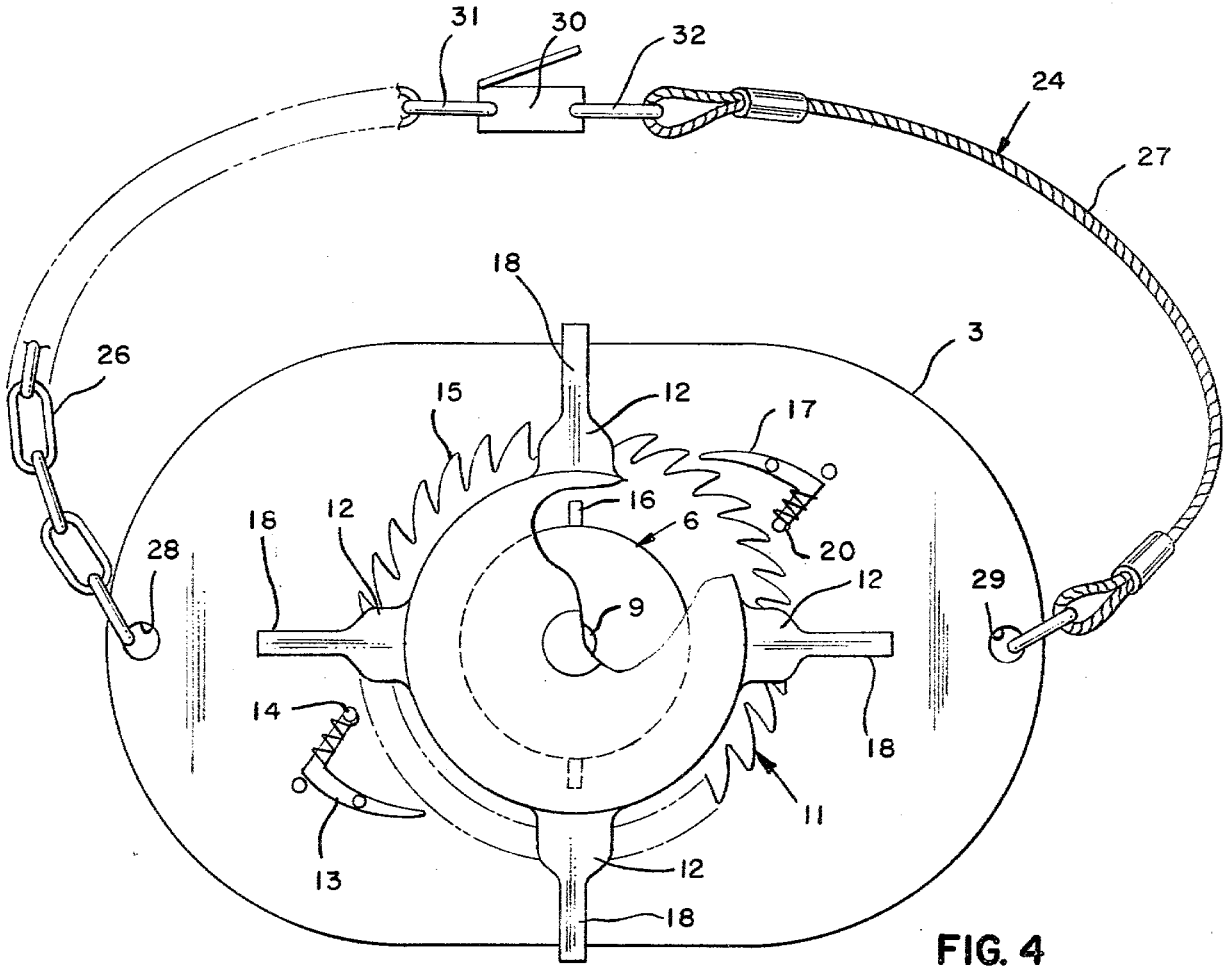
FIG. 4 is a front view of the device shown in FIG. 1.
Figure 5:
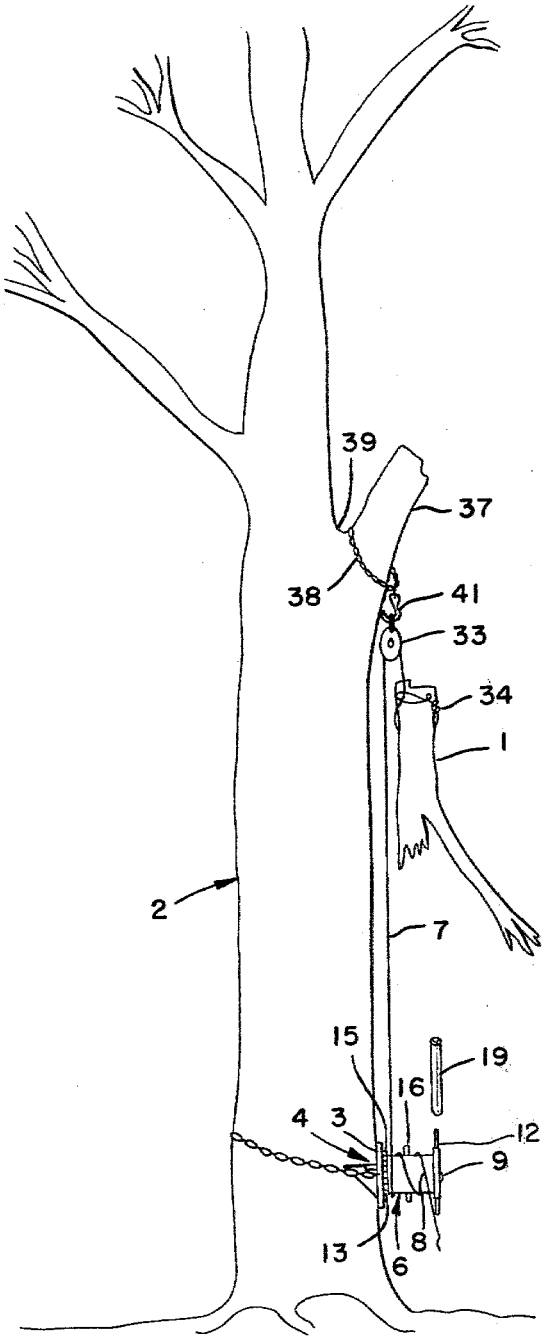
FIG. 5 is a side view of the device as used in lowering a severed tree limb.

The load handling device for handling heavy tree limbs 1 and main stems 2 consists of a base 3, means 4 attached to the base and adapted for temporary secure engagement with the tree truck, and a cylindrical member 6 mounted on the base and positioned with its longitudinal axis generally at right angles to the axis of the tree.

In its basic form, the lowering rope 7 is attached over another limb, crotch or through a pulley and the lower end 8 of the rope is wrapped several times around the cylinder. After the limb or stem is severed, a single operator located on the ground can easily lower the heavy load to the ground because of the friction between the rope and the cylinder.

In another form of the invention, an axle 9 is connected to the base and positioned at right angles to the axis of the tree. The cylindrical member is mounted for rotation on the axle. A ratchet means 11 is mounted on the base and the cylindrical member for selectively preventing rotation of the cylindrical member in at least one direction. A lever member 12 is attached to the cylindrical member at right angles to the axle. The ratchet means consists of a pawl 13 pivotally attached by a pin 14 to the base. The ratchet teeth 15 are formed in the cylindrical member to engage the pawl.

In another form of the invention, a pin member 16 may be mounted on the cylindrical member and radially protrude therefrom. The purpose of the pin is to prevent the rope from becoming wound upon itself and thereby prevent smooth frictional movement around the cylindrical member as it is released by the operator working on the ground.

Preferably a second pawl 17 is attached to the base by pin 20 so that the cylindrical member may be prevented from turning in both directions.

As shown in the drawings, the lever member 12 is formed with an extension receiving end 18. An extension member 19 is selectively connectable to the lever member for increasing the mechanical advantage of the lever member. Four lever members are illustrated but only one is essential to the operation of the device. The additional levers simply add to the convenience in use of the device.

The device may be attached to the tree trunk in various ways. In the preferred form illustrated, a cross member 21 protrudes from the base at right angles. The cross member engages the underside of a slash or cut 22 in the tree which is made at right angles to the axis of the tree. This slash or notch with sloping side 23 can be easily made by a gasoline powered chain saw which the operator trimming the tree carries.

One way of connecting the device to the tree trunk is to hook an elongated member 24 such as a chain 26 or cable 27 to both ends of the device at openings 28 and 29. It has been found that a nylon strap will hold the device securely. A cinching means such as a chain binder 30 then is used to draw the two ends 31 and 32 of the chain together so that the device is securely held to the tree. When a nylon strap is used, a nylon web cinching means can be used.

In most instances, the device is used in conjunction with a pulley 33 which is attached to the tree just below the limb or main stem to be cut.

In operation, the device is used in the following manner. A notch is made in the trunk of the tree with a hand saw or powered chain saw. Cross member 21 is then placed against cut 22 of the notch and elongated member 24 is placed around the tree and the ends cinched tight by a chain or nylon web binder 30. Pulley 33 is attached to a limb 37 by placing a tie rope 38 in the limb crotch 39 of the tree. The pulley may be attached to tie rope 38 by hook 41. The end 34 of rope 7 is then tied to the limb 1 to be severed. Pawls 13 and 17 are then set in engagement with ratchet teeth 16. The lower end 8 of the rope is then wound around cylindrical member 6 several turns and tied in a half hitch about lever 12 or pin 16.

Cylinder member 6 is then turned to take up the slack in rope 7. As a safety precaution, the ground operator should stand clear while the limb is cut. After the limb drops and the weight is supported by the pulley, the operator on the ground removes the half hitch and lowers the limb to the ground by permitting the lower end of the rope to slip slowly around the cylindrical member.

If the limb 1 being lowered gets hung up and can't be lowered past an obstruction, the ground operator can tie off the lower end of the rope on the pin 16 or lever member 12. One of the pawls is disengaged to permit rotation of the cylindrical member. Lever extension 19 is then inserted over extension receiving end 18 of lever member 12 and the operator turns the cylindrical member to raise the limb. Once the obstruction is cleared the operator sets the pawl to prevent rotation of the cylindrical member, the lower end of the rope is untied and the rope is once again permitted to slip in a controlled manner around the cylindrical member.

Figure 6:
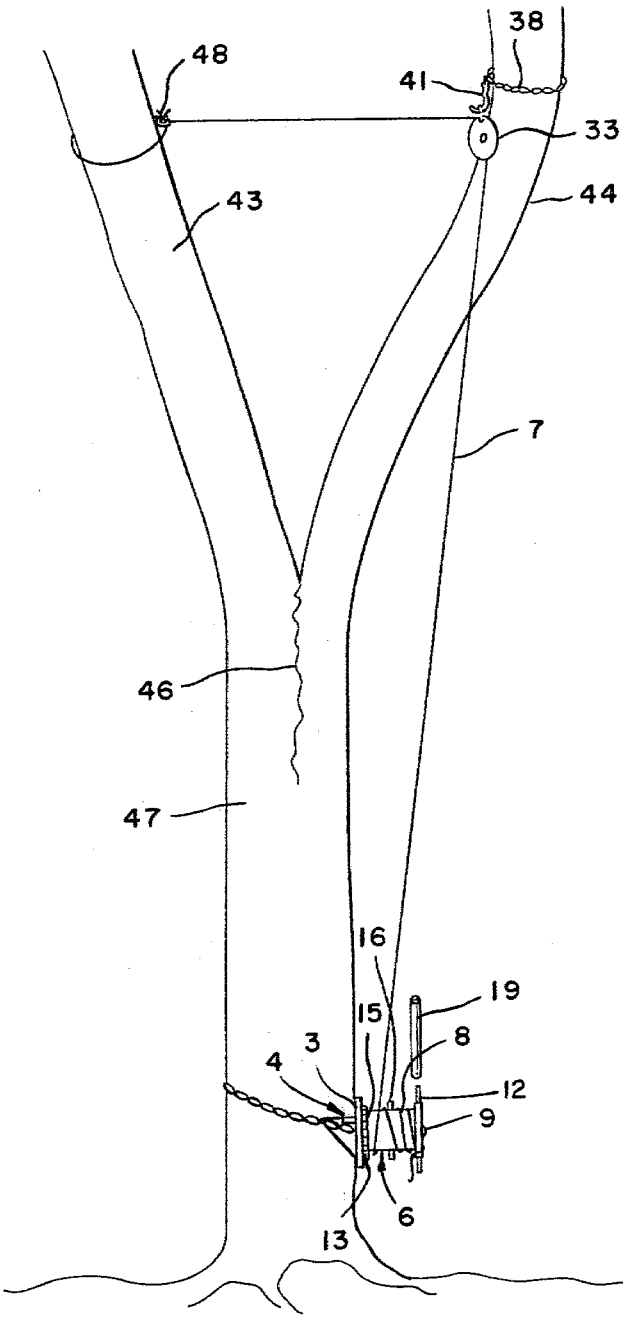
FIG. 6 is a side view of the device shown in use in multiple stem trees.
Figure 7:
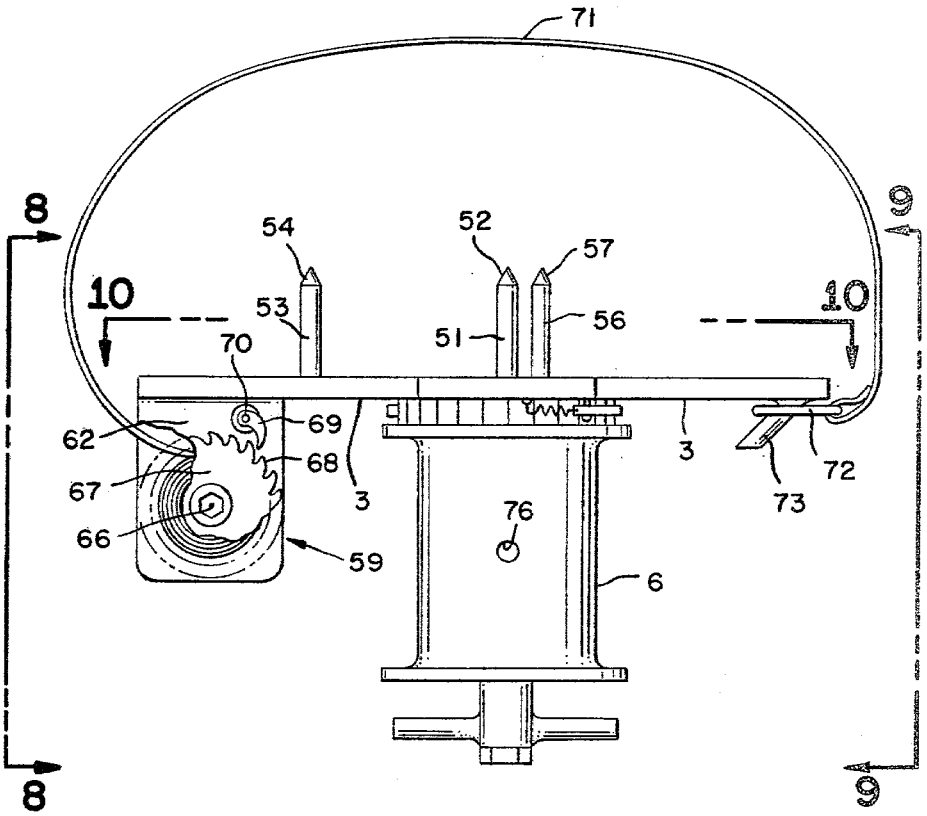
FIG. 7 is a plan view of an alternate form of the invention.
Figure 8:
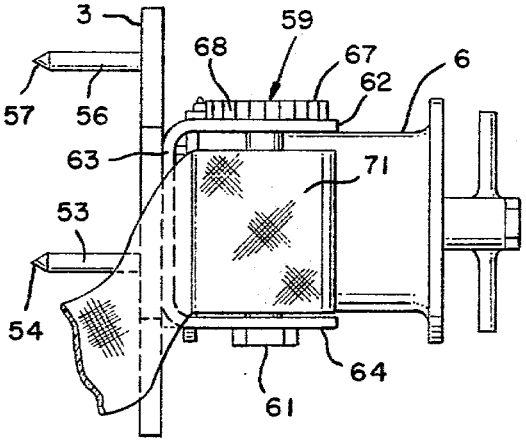
FIG. 8 is a side view of the device taken in the direction of line 8—8 as shown in FIG. 7.
Figure 9:
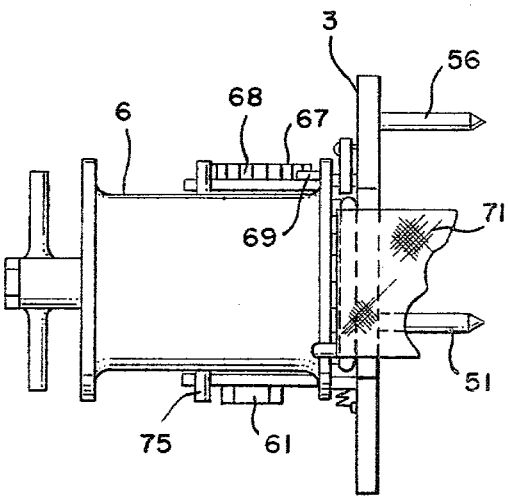
FIG. 9 is a side view of the device taken in the direction of line 9—9 as shown in FIG. 7.
Figure 10:
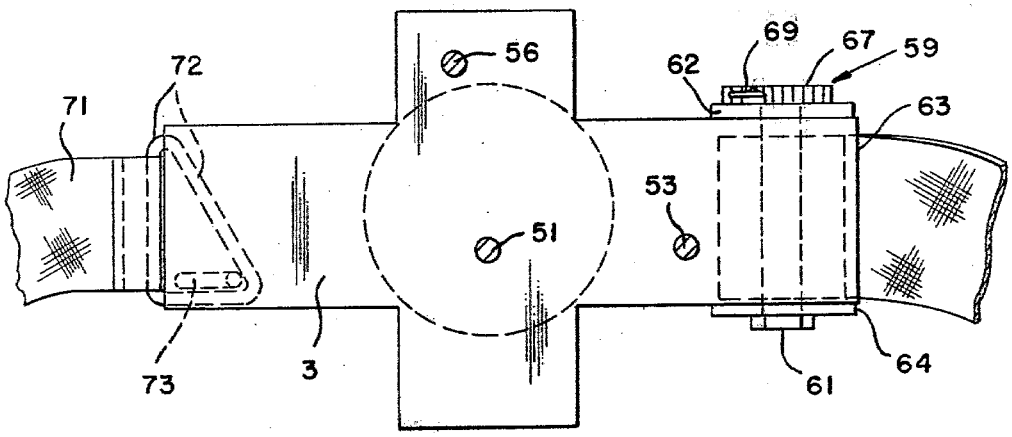
FIG. 10 is a side view of the device taken in the direction of line 10—10 as shown in FIG. 7.
Figure 11:
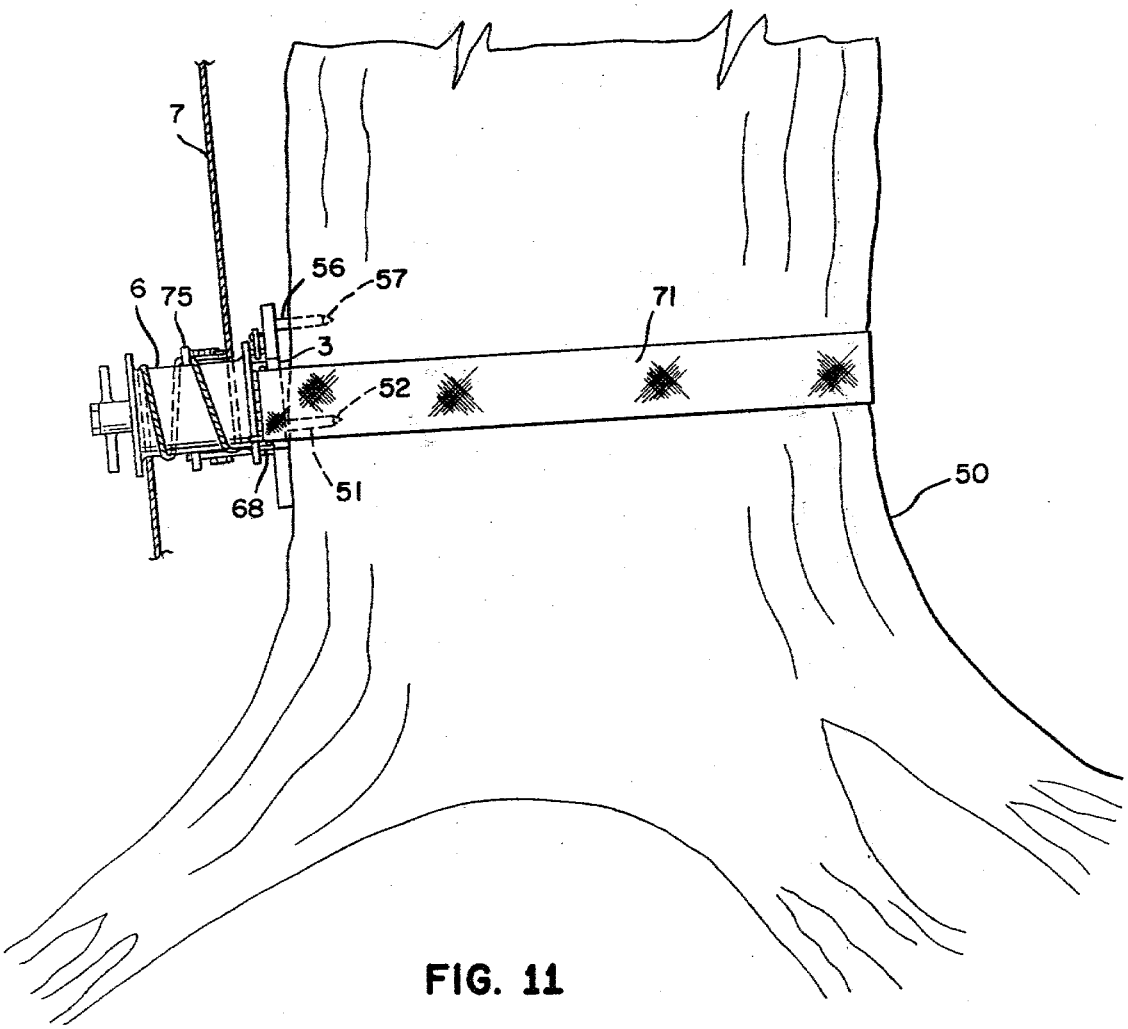
FIG. 11 is a side view of the device similar to FIG. 9 with the device shown mounted on a tree in phantom line.

FIG. 6 illustrates the manner in which the device may be used when two stems 43 and 44 must be moved toward one another to repair a split 46 in tree stem 47. Tie member 38 is attached to stem 44 and pulley 33 is attached to hook 41. End 48 of rope 7 is tied around tree stem 43. The ratchets are set to permit rotation of the cylindrical member in one direction. The lower end 8 of the rope is wound around the cylindrical member 6 and tied off. Lever 19 is then placed in extension receiving end 18 of lever member 12 and the cylindrical member is turned about axle 9 until the tree stems are bound together. The pawl on the ratchet is then set so that the tension will be maintained on rope 7.

A modified form of the invention is shown in FIGS. 7–11. The operation of the modified device is identical to the device illustrated in FIGS. 1–6.

The only difference is the fact that the means for temporary secure engagement with the tree trunk is different. A first pin 51 is attached to base 3 and is formed with a pointed end 52 for puncturing the tree trunk 50 and preventing vertical movement of the device with respect to the tree.

To prevent rotation of the device with respect to the trunk and to further assist in preventing vertical movement, a second pin 53 is attached to the base. The second pin is also formed with a pointed end 54 so that it may be easily forced into the tree. The second pin is preferably located horizontally spaced from said first pin.

Placement means may be attached to the base. The placement means may be either a spacer member which is attached to the base and rests against the tree or it preferably is a placement pin 56 with a sharpened end 57 which is forced partially into the tree. The placement means is mounted above the first and second pins and its purpose is to tilt the entire device outwardly with respect to the side of the tree.

A further improvement in the device is to provide a winch means 59 which is attached to the base. The winch may consist of a drum 60 mounted on a pin 61 whose axis is at right angles to the cylinder member 6. The drum is mounted on a plate 62 which is attached to base 3. Preferably plate 62 is part of a U-shaped member with vertical member 63 welded to base 3 and bottom plate 64 holding pin 61. A suitable opening 66 is formed in the center of the drum to receive a crank for turning the drum. As shown, a hexagonal faced opening is formed in the drum for receiving a crank. Ratchet wheel 67 with ratchet teeth 68 are attached to the drum and engage a pawl 69 mounted on pivot 70 attached to plate 62.

An elongated flexible member 71 such as a rope, cable or strap is mounted on the winch means and adapted for encircling the tree trunk. It has been found that a woven nylon strap provides sufficient strength to hold the device to the tree trunk, yet is light and durable.

A hook means, such as a D-ring 72 may be attached to the end of the strap. A hook means such as a protruding member 73 may be attached to the end of the base. The D-ring engages the hook easily and securely.

Operation of the attachment means is as follows. The device is set against the side of the tree at the approximate location selected. The pointed ends of the pins are set against the tree trunk; ready for engagement. Strap 71 is placed around the tree and the D-ring is placed over the hook 73. A crank is placed in crank opening 66 and the pawl 69 is engaged with the ratchet teeth 68. The winch is turned and pins 51 and 53 are slowly forced into the tree. Since the placement means or pin 56 is mounted above the winch and hook, it is not driven as far into the trunk as pins 51 and 53. Thus the cylindrical member 6 is placed at an angle to the tree so that rope 7 which will normally be attached outwardly from the trunk of the tree will remain at an approximately right angle with respect to the axis of cylindrical member 6.

When all of the limbs have been removed from the tree and lowered to the ground, the device may be removed from the tree. Only three small puncture holes will be left in the tree and these may be filled and plugged according to accepted tree surgery practices so that the tree will not be permanently damaged.

A further modification of the device which may be used with all of the forms of the invention described is the use of a removable pin 75 in the cylindrical member 6. A hole 76 may be placed in the cylindrical member and the pin slid into the opening. When not needed, the pin may be simply removed. It has been found in practice that when the device is to be used for winching purposes only, it is preferable that the pin be removed.

As shown in the drawings, when the device is formed with pointed pins, it is unnecessary to make a v-cut or gash in the side of the tree. The pointed pin attachment is preferable where the entire tree is not removed and it is desirable to injure the tree as little as possible.

The device may be lifted, installed, operated, and removed from the tree by one man thus enabling a tree crew to work more quickly and efficiently together.

I claim:

1. A load handling device for arborists for handling heavy tree limbs and main stems comprising:

a. a base (3);

b. means (4) attached to said base and adapted for temporary secure engagement with a tree trunk;

c. a cylindrical member (6) mounted on said base and positioned with its longitudinal axis generally at right angles to the axis of said tree; and d. said means attached to said base includes a cross member (21) protruding from said base and adapted for engaging a slash or cut 22 in said tree made at right angles to the axis of said tree.

2. A device as described in claim 1 comprising:

a. an axle (9) connected to said base and positioned generally at right angles to the axis of said tree;

b. said cylindrical member is mounted for rotation on said axle;

c. ratchet means (11) mounted on said base and said cylindrical member selectively preventing rotation of said cylindrical member in at least one direction; and d. a lever member (12) attached to said cylindrical member at right angles to said axle.

3. A device as described in claim 2 comprising:

a. a pin member (16) connected to said cylindrical member and positioned at right angles to said axle.

4. A device as described in claim 2 comprising:

a. a pair of ratchet pawls 13 and 17 preventing selective rotation of said cylindrical member in both directions.

5. A device as described in claim 2 comprising:

a. said lever member is formed with an extension receiving end (18); and b. an extension member (19) selectively connectable to said lever member for increasing the mechanical advantage of said lever member.

6. A device as described in claim 1 comprising:

a. an elongated member 24 connected to said base and adapted for encircling said tree member; and b. cinching means for engaging said elongated member for securely holding said elongated member and said device to said tree.

7. A device as described in claim 2 comprising:

a. a pulley member adapted for securing to said tree above said device; and b. an elongated member (7) adapted for engaging a limb or portion of said tree to be cut and lowered to the ground and threaded through said pulley and encircling said cylinder at least one turn.

8. A load handling device comprising:

a. a base (3);

b. means (4) attached to said base and adapted for temporary secure engagement with a tree trunk;

c. a cylindrical member (6) mounted on said base and positioned with its longitudinal axis generally at right angles to the axis of said tree; and d. said means for temporary secure engagement with a tree trunk includes a first pin (51) attached to said base having a pointed end for puncturing said trunk and preventing vertical movement of said device.

9. A load handling device as described in claim 8 comprising:

a. said means for temporary secure engagement with a tree trunk further includes a second pin (53) having a pointed end spaced laterally from said first pin for preventing rotation of said device and preventing vertical movement of said device; and b. placement means (56) attached to said base and adapted for engagement with said tree trunk and mounted above said first and second pins for tilting said base outwardly with respect to said side of said tree.

10. A load handling device comprising:

a. a base (3);

b. means (4) attached to said base and adapted for temporary secure engagement with a tree trunk;

c. a cylindrical member (6) mounted on said base and positioned with its longitudinal axis generally at right angles to the axis of said tree;

d. winch means (59) attached to said base;

e. an elongated flexible member (71) mounted on said winch means adapted for encircling said tree trunk;

f. hook means (73) mounted on said base spaced from said winch means;

g. catch means (72) mounted on the end of said elongated member for engagement with said hook means; and h. ratchet means (67) and (69) mounted adjacent said winch means for holding said strap at a preset position.

11. A load handling device comprising:

a. a base (3);

b. means (4) attached to said base and adapted for temporary secure engagement with a tree trunk;

c. a cylindrical member (6) mounted on said base and positioned with its longitudinal axis generally at right angles to the axis of said tree;

d. said cylindrical member is formed with an opening (76) in the face thereof;

e. a pin (75) dimensioned for receipt with said opening in said cylindrical member; and f. said pin and said opening are dimensioned so that said pin may be easily removed.

* * * * *

UNITED STATES PATENT AND TRADEMARK OFFICE

CERTIFICATE OF CORRECTION

PATENT NO. : 4,239,188
DATED : December 16, 1980
INVENTOR(S) : EDWIN L. HOBBS

It is certified that error appears in the above-identified patent and that said Letters Patent are hereby corrected as shown below:

In Column 2, line 22, delete [truck] and insert --- trunk ---

In Column 6, line 55, delete [with] and insert --- within ---

Signed and Sealed this

*Tenth* Day of *March 1981*

[SEAL]

*Attest:*

RENE D. TEGTMEYER

*Attesting Officer* *Acting Commissioner of Patents and Trademarks*